US007896284B2

(12) United States Patent
Morelli et al.

(10) Patent No.: US 7,896,284 B2
(45) Date of Patent: Mar. 1, 2011

(54) METHOD AND MACHINE FOR THE PRODUCTION OF LOGS OF WOUND WEB MATERIAL

(75) Inventors: Roberto Morelli, S. Maria a Colle (IT); Mauro Gelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 939 days.

(21) Appl. No.: 10/588,797

(22) PCT Filed: Feb. 4, 2005

(86) PCT No.: PCT/IT2005/000051

§ 371 (c)(1),
(2), (4) Date: Aug. 28, 2006

(87) PCT Pub. No.: WO2005/075328

PCT Pub. Date: Aug. 18, 2005

(65) Prior Publication Data

US 2009/0001210 A1 Jan. 1, 2009

(30) Foreign Application Priority Data

Feb. 9, 2004 (IT) ..... FI2004A0028

(51) Int. Cl.
*B65H 19/28* (2006.01)

(52) U.S. Cl. ..... 242/532.1; 242/532.3; 242/533.3; 242/535.4; 242/541.3

(58) Field of Classification Search ..... 242/532, 242/532.1, 532.3, 532.7, 533, 533.1, 533.3, 242/535.4, 541.3

See application file for complete search history.

(56) References Cited

U.S. PATENT DOCUMENTS

| | | | | |
|---|---|---|---|---|
| 4,327,877 | A | 5/1982 | Perini | |
| 5,368,252 | A | 11/1994 | Biagiotti | |
| 5,383,622 | A | 1/1995 | Kohler | |
| 5,979,818 | A * | 11/1999 | Perini et al. | 242/521 |
| 6,565,033 | B1 | 5/2003 | Biagiotti | |
| 6,752,345 | B2 * | 6/2004 | Betti et al. | 242/532.3 |
| 6,945,491 | B2 * | 9/2005 | Gambini | 242/521 |
| 7,523,884 | B2 * | 4/2009 | Gelli et al. | 242/521 |
| 2002/0153447 | A1 * | 10/2002 | Perrigo et al. | 242/523.1 |

FOREIGN PATENT DOCUMENTS

| | | | |
|---|---|---|---|
| EP | 1 219 555 | A1 | 7/2002 |
| GB | 1 435 525 | | 5/1976 |
| GB | 2 105 687 | A | 3/1983 |
| GB | 2 150 536 | A | 7/1985 |
| WO | WO 94/21545 | A1 | 9/1994 |
| WO | WO 01/72620 | A1 | 10/2001 |

* cited by examiner

*Primary Examiner*—Sang Kim
(74) *Attorney, Agent, or Firm*—Breiner & Breiner, LLC

(57) ABSTRACT

A rewinding machine is described including: a path for feeding the web material towards a winding system; interruption members to interrupt the web material at the end of winding of a log; a core insertion channel, defined by a rolling surface and a movable member; a core feeder to insert winding cores in succession in the channel; an electrostatic device positioned along the channel to electrostatically charge the winding cores and/or the web material thus causing, due to the electrostatic charges, reciprocal adhesion of the core and initial free edge of the web material obtained by interruption of the material at the end of winding of each log.

32 Claims, 7 Drawing Sheets fN
N
105
13
1
3
11
111
A1
501
X
113
7
R
5
7A
A3
19
P
17
A4
9
A2
15
503
21
2 fN
N
105
13
1
3
11
111
A1
501
X
113
7
R
5
7A
A
N
L1
Lf
17
A
9
A2
15
503
19
21
2 fN
N
105
13
1
3
7A
11
111
A1
501
X
113
R
5
LF
A4
A3
A2
L1
17
9
15
503
19
21
2

METHOD AND MACHINE FOR THE PRODUCTION OF LOGS OF WOUND WEB MATERIAL

TECHNICAL FIELD

The present invention concerns a rewinding machine for winding a web material to form logs intended for example but not exclusively for the production of toilet rolls, kitchen paper and similar. More in particular, but not exclusively, the invention concerns a so-called peripheral rewinding machine, i.e. in which the logs are formed by winding the web material in a winding cradle formed by winding members in contact with the outer surface of the log. The invention also concerns a winding method and more in particular, but not exclusively, a so-called peripheral winding method.

STATE OF THE ART

For the production of logs of paper, so-called tissue paper or other web materials rewinding machines are used to which the material to be wound is fed, and which produce logs with a pre-set quantity of wound material. The web material is fed typically by unwinders, i.e. machines that unwind one or more large diameter reels coming, for example, from a paper mill.

The logs can be sold as is, or can undergo further transformation operations; typically they are cut into logs of shorter axial length, equal to the final dimension of the rolls offered for sale.

The rewinding is in some cases performed by so-called central rewinding machines, i.e. in which the logs are formed around motor-driven mandrels, on which winding cores made of cardboard or similar material may be fitted, designed to remain inside the logs.

The latest rewinding machines are based on the principle of so-called peripheral or surface winding. In this case the log forms in a winding cradle, defined by rotating winding rollers or by other winding members such as belts, or combinations of rollers and belts.

Combined systems are also known in which winding is obtained by means of peripheral members, combined with a system for control of the log axis in the formation phase. In both the central winding systems and peripheral winding systems machines are sometimes used in which the mandrel or winding core is extracted from the finished log so that the end product is a log provided with a central hole, without axial core. Examples of peripheral rewinding machines of this type are described in WO-A-0172620.

The rewinding machines, both peripheral and central, operate automatically and continuously, i.e. the web material is fed in continuously without stopping and at a substantially constant speed. The web material is provided with crosswise perforation lines which divide the material into single portions which can be separated from the roll for the end use. Typically the aim is to produce logs with a pre-set and precise number of said portions or sheets.

When a log or roll has been completed, the switchover phase must be performed in which the log formed is discharged and the web, material is interrupted, forming a final edge of the complete log and an initial edge of the subsequent log. The initial edge begins to wind to form a new log. The interruption occurs preferably along a perforation line, so that the end product contains a whole pre-set number of portions of web material.

These operations take place without substantial variations in the feed speed of the web material and represent the most critical moment of the winding cycle. In modern rewinding machines for the production of tissue paper, the feed speed of the web material reaches and exceeds speeds in the order of 1000 m/min, with winding cycles which sometimes last less than 2 seconds.

It is therefore important to provide efficient, reliable and flexible systems for obtaining adhesion of the initial free edge of the web material to the new winding core, in order to begin winding of each log.

In GB-A-1435525 a rewinding machine is described in which interruption of the web material is performed by means of a blade or jet of compressed air which tears the web material or generates a loop which wedges between the new winding core inserted in the winding cradle and one of the winding rollers. Jets of air cause the first turn of web material to wind around the core.

In U.S. Pat. No. 4,327,877 a rewinding machine is described in which the web material is interrupted by the combined action of suction across the surface of one of the winding rollers and pinching of the web material between the new core inserted in the winding cradle and the suction winding roller. The suction forms a loop of material which is pinched and pulled in the opposite direction with respect to that of feed of the web material which winds around the log as it is being completed. Winding of the initial edge around the new core is obtained by currents of air.

In more modern machines beginning of winding is obtained by causing the initial free edge to adhere to the new core by means of glue applied on the free edge or, preferably, on the core.

In GB-A-2150536 and U.S. Pat. No. 5,368,252 rewinding methods and machines are described in which the web material is torn at the end of winding solely by means of controlled acceleration of one of the winding rollers. The same system based on the principle of tearing the web material along a perforation line by means of acceleration of one of the winding rollers is described in EP-A-1.219.555. The free edge of the web material produced by the tear adheres to the new core by means of glue applied on the core.

In GB-A-2105687 a rewinding method and a machine are described in which interruption of the web material is performed via cuffing by a blade in a channel of one of the winding rollers. Also in this case adhesion of the initial free edge formed by the cut on the new core is obtained by means of glue applied on the core.

A particularly reliable and flexible method and machine are described in U.S. Pat. No. 5,979,818. In this case the tear is performed by a movable member which cooperates with one of the winding rollers around which the web material runs, or with a belt running around said roller and which supports the web material as it is fed towards the winding cradle. The difference in speed between the winding roller and the web material on the one hand and the movable member on the other causes tearing of the web material along a perforation line. The core is provided with glue for adhesion of the initial free edge of the core. With respect to the previous tear systems, this known rewinding machine permits very high winding precision, also at high speeds, with a relatively simple and economic configuration, which also permits a high level of production flexibility.

OBJECTS AND SUMMARY OF THE INVENTION

The object of the invention is to produce a winding method and a rewinding machine with an efficient system for application of the initial free edge to the winding core at the beginning of each winding cycle.

These and further aims and advantages, which will be clear to persons skilled in the art from reading of the following text, are substantially achieved with a rewinding machine comprising: a path for feeding the web material towards a winding system, preferably of the so-called peripheral or surface type; an interruption member to interrupt the web material at the end of winding of a log; a core feeder to insert winding cores in succession towards the winding system; and an electrostatic device to electrostatically charge the winding cores and/or the web material, causing adhesion on the cores, due to the electrostatic charges, of the initial free edge of the web material obtained by interruption of the material at the end of winding of each log.

The use of a system of electrostatic charging of the cores and/or of the web material eliminates the use of glue for adhesion of the initial free edge of the web material to the core on which the log has to be wound each time. Compared to other glue-free winding systems, in which the first turn is wound by means of jets of air or other pneumatic systems, the use of electrostatic charges guarantees greater reliability also at high production speeds, typical of modern rewinding machines. The electrostatic charge is applied preferably on the cores, instead of on the web material, or on both the cores and (with opposite sign) on the web material.

In practice, the invention provides for a rewinding machine comprising: a path for feeding the web material towards a winding system; interruption members to interrupt the web material at the end of winding of a log; a core insertion channel, defined by a rolling surface and a movable member; a core feeder to insert winding cores in succession in said channel; an electrostatic device positioned along said channel to electrostatically charge the winding cores and/or the web material in order to cause, due to the electrostatic charges, reciprocal adhesion of the core and free initial edge of the web material obtained by interruption at the end of winding of each log.

The movable member can consist of a core feed member and can comprise a belt or a series of parallel belts or other flexible member, running around rollers, for example also around one of the winding rollers defining the winding cradle for formation of the log. In a modified embodiment, the movable member or the feed member can consist of one of the winding rollers, typically the winding roller of a peripheral winding cradle, on which the web material runs. In this case the rolling surface develops around a portion of the winding roller.

With this arrangement, each core is electrostatically charged very near to the moment when the initial free edge forms due to interruption of the web material and adheres to the core. This avoids the risk of dispersion of the electrostatic charges from the core before the latter comes into contact with the initial portion of the web material to be wound. The electrostatic discharges can, alternatively or in combination, be applied to the web material, also in this case at a moment which is advantageously very near to or coinciding with the moment in which adhesion to the new core must take place.

In a configuration of this type, the interruption member can be advantageously combined with the movable member or feed member and positioned on the opposite side with respect to the channel to act on the web material through the feed member. With this arrangement the entire area below the core rolling surface is free and this offers a number of advantages, including possible simplification of the structure defining the core rolling surface, and also easier arrangement of the electrostatic device.

The electrostatic device can comprise one or more high voltage bars, connected to a voltage source.

In an advantageous embodiment the feed member comprises a flexible member, for example advantageously consisting of a plurality of parallel belts, running between at least two rollers. One or more charging bars of the electrostatic device can in this case be advantageously arranged between these two rollers, within the closed path defined by the flexible member. The interruption member can also be advantageously positioned in the same area between the two rollers, with the closed path of the flexible member. One of said rollers can constitute the first winding roller of a peripheral winding cradle forming the winding system, which in this case is a peripheral or so-called surface winding system. Feeding of the web material to the winding system is preferably continuous and at a substantially constant speed, also during the switchover phases, i.e. interruption of the web material and insertion of the new winding core. Alternatively, the channel can be defined between the rolling surface and a winding roller around which the web material runs. In this case one or more electrostatic charging bars can be positioned along the channel, below the rolling surface.

The web material interruption member can be of various type and designed according to one or more of the known techniques, based on blade cutting or air jet systems, pinching and tear systems or with synchronized variation of the rotation speeds of the winding rollers or a combination of these systems. In a possible embodiment of the invention, the interruption member is a suction member which applies a force on the web material, which obstructs the feed thereof. For example the suction member can comprise a counter surface along which said flexible member runs. In an alternative embodiment, the interruption member is a mechanical member, which acts on the web material obstructing the feed thereof. For example, the mechanical interruption member can be synchronized with the core feeder, to act on the web material in conjunction with a winding core which is moving along the channel. The web material can, in this case, be pinched between the core and the interruption member. The interruption member can also act at a different point, however, and preferably downstream of the core in the feed direction of the web material.

According to a different aspect the invention concerns a method for the production of logs of wound web material, comprising the following steps:

- feeding the web material to a winding system;
- winding a first log of web material around a first winding core;
- interrupting the web material at the end of winding of said first log, forming a final free edge of said first log and a initial free edge for winding of a second log;
- adhering the initial free edge to a second winding core to begin formation of a second log by reciprocal electrostatic attraction between core and free edge.

According to a particular aspect, the invention concerns a method for the production of logs of wound web material, comprising the following steps: feeding the web material to a winding system; winding a first log of web material around a first winding core; interrupting the web material at the end of winding of said first log, forming a final free edge of said first log and a initial free edge for winding of a second log; adhering said initial free edge to a second core by application of electrostatic charges that cause reciprocal attraction between core and free edge; and in which said electrostatic charges are applied after the core has come into contact with the web material.

According to a different aspect, the invention provides a method for the production of logs of wound web material, comprising the following steps: feeding the web material to a winding system; winding a first log of web material around a first winding core; interrupting the web material at the end of winding of said first log, forming a final free edge of said first log and a initial free edge for winding of a second log; adhering said initial free edge to a second core by application of electrostatic charges that cause reciprocal attraction between core and free edge; in which said cores are inserted in an insertion channel defined by a rolling surface and a movable member, the electrostatic charges being applied at the level of said channel.

In a practical embodiment, the core is electrostatically charged to cause adhesion of the initial free edge on it.

These measures prevents dispersion of the electrostatic charge applied on the core and/or on the web material, wholly or in any case to an extent that affects operation thereof, before it has caused attraction and adhesion of the initial free edge; according to an advantageous embodiment of the method according to the invention the second core is brought into contact with the web material before electrostatically charging it. Preferably, the web material is interrupted, thus forming the initial free edge, after the core has been brought into contact with the web material and preferably immediately after said core has been electrostatically charged or while said core is electrostatically charged.

Further advantageous characteristics and embodiments of the rewinding machine and winding method according to the invention are indicated in the appended claims and will be described in further detail below with reference to some advantageous embodiment examples.

BRIEF DESCRIPTION OF THE DRAWINGS

The invention will be better understood by following the description of practical and advantageous non-limiting examples of embodiment of the invention, shown in the attached drawings. In the drawings.

DETAILED DESCRIPTION OF THE PREFERRED EMBODIMENTS OF THE INVENTION

Figure 1A:
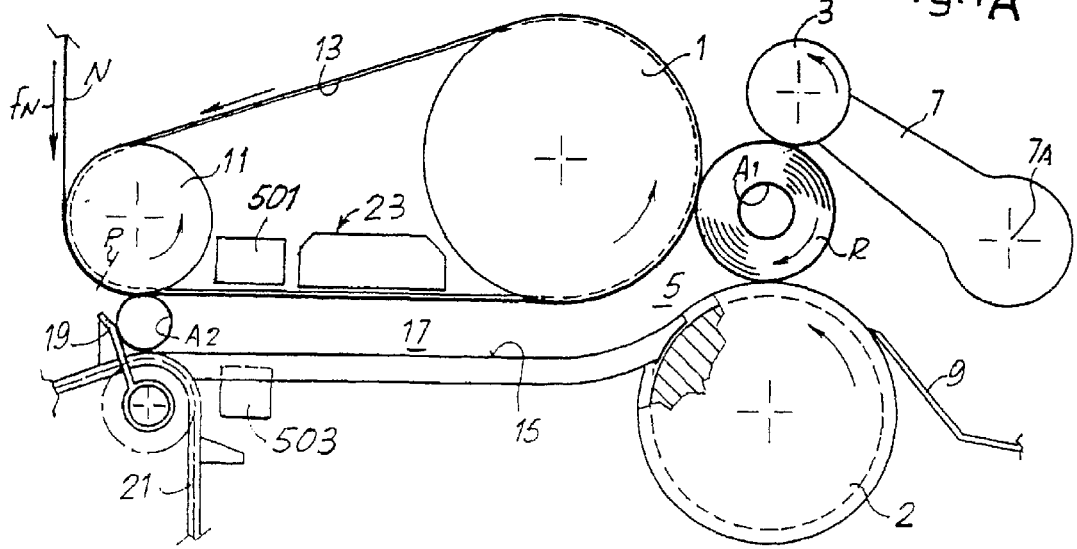
FIG. 1A to 1D show an operating sequence of a machine according to the invention in a first embodiment.

Embodiment examples with a peripheral winding system are described below. It should be understood, however, that the principles underlying the invention can also be combined with a central winding system.

The appended drawing shows the basic elements of the machine according to the invention, in a representation that illustrates the operating mode thereof. In the embodiment shown in FIG. 1A-1D, the rewinding machine comprises a winding cradle formed by three winding rollers, namely: a first winding roller 1, a second winding roller 2 and a third winding roller 3. The three rollers 1, 2, 3 rotate around parallel axes and at peripheral speeds which—during the winding cycle—are substantially the same, whereas they can vary in a per se known manner at the end of winding to discharge the complete log and/or to insert the new core, around which winding of the subsequent log has begun, via a nip 5 defined between the winding rollers 1 and 2.

The winding roller 3 is supported on a pair of oscillating arms 7, hinged around an oscillation axis 7A. The oscillation movement permits build-up of the log R being formed inside the winding cradle 1, 2, 3 and discharge of the complete log via a chute 9.

The web material to be wound to form the logs R is indicated by N. It moves along a feed path which crosses a perforation unit (not shown) which perforates the material N in a known manner along perforation lines substantially perpendicular to the feed direction fN of the material N. Downstream of the perforation unit the web material N runs around a guide roller 11 revolving around an axis parallel to the axis of the winding rollers 1, 2 and 3. The web material feed path then proceeds for a section tangent to the rollers 1 and 11 defined by a flexible feed member 13 consisting of a plurality of flat parallel belts running around rollers 1 and 11. The feed member serves above all to insert and feed forward the tubular winding cores A around which the logs R are wound, as will be clarified subsequently. Since the belts forming the feed member 13 run around the rollers 1 and 11, they move forward at the same speed as the web material N and therefore there is no relative movement between the latter and the belts.

Below the portion of the feed member parallel to the web material N, there is a curved rolling surface 15 defined by a metal sheet or bent bar, a plurality of metal sheets or bent bars parallel to each other or a comb-type structure. Between the rolling surface 15 and the feed member 13 an insertion and feed channel for the winding cores is defined, indicated by 17, which is provided with an inlet on the left side of the figures and an outlet corresponding substantially to the nip 5 between the winding rollers 1 and 2. The terminal part of the channel is therefore defined between the rolling surface 15 and the outer surface of the winding roller 1 around which the feed member 13 runs, the rolling surface being arched so that it is roughly coaxial with the surface of the roller 1. The terminal part of the surface 15 penetrates into ring-shaped grooves provided in the winding roller 2, to permit easy passage of the cores that roll on the surface 15 towards the nip 5 and from here to the winding cradle 1, 2, 3.

Near the inlet of the channel 17 a core talker-in is provided, consisting of a rotating element 19 which, at the appropriate moment, inserts a winding core A in the channel 17. The cores are positioned in front of the taker-in 19 by means of a chain conveyor 21. Operation of the core insertion mechanism is known to persons skilled in the art, for example from one or more of the patents referred to in the introductory part of this description, and will not be described in further detail.

The height of the channel 17 is equal to or slightly less than the outer diameter of the winding cores A which, therefore, when they are pushed into said channel by the taker-in 19, are angularly accelerated and roll on the surface 15 pushed by the movement of the feed member 13. The web material N remains pinched between the belts forming the feed member 13 and the core inserted in the channel.

Above the lower branch of the feed member 13 a suction member is provided indicated overall by 23 and described in greater detail below. It has a suction area which extends crosswise to the feed direction of the cores A and to the web material N. The suction member applies suction to the web material N in the switchover phase, i.e. when the log R is almost complete and the web material N must be interrupted to generate a final free edge to be wound on the finished log R and a initial free edge to be wound on a new core A inserted in the channel 17 to start winding of a new log. The suction generates a force orthogonal to the lower surface of the suction member 23. The consequent friction force exerted on the web material by said surface is sufficient to cause tensioning and breakage of the material.

In the space inside the closed path formed by the feed member, an electrostatic charge bar is positioned, indicated by 501. A second bar, indicated by 503, is positioned below the rolling surface 15. These bars and the high voltage generators connected to them are per se known to persons skilled in the art and are used, for example, to electrostatically charge plastic films, or—on the contrary—as ionizers to eliminate electrostatic charges from plastic films or other products. Electrostatic charging devices that can be used in this application can be, for example, the devices marketed by Haug GmbH & Co KG (Germany) or by Haug Biel AG (Switzerland) under the codes ALS-A and ALS-R. The bars 501 and 503 apply charges with opposite sign so that the web material N is charged with one sign and the cores are charged with the opposite sign. The charge sign can depend on the material constituting the material N and the cores A.

It is also possible to use one single bar or even several bars of the same sign and arranged so as to charge only the cores or, although less preferable, only the web material. In any case, the reciprocal adhesion between cores and web material is always obtained due to the electrostatic charges with opposite sign.

Figure 1B:
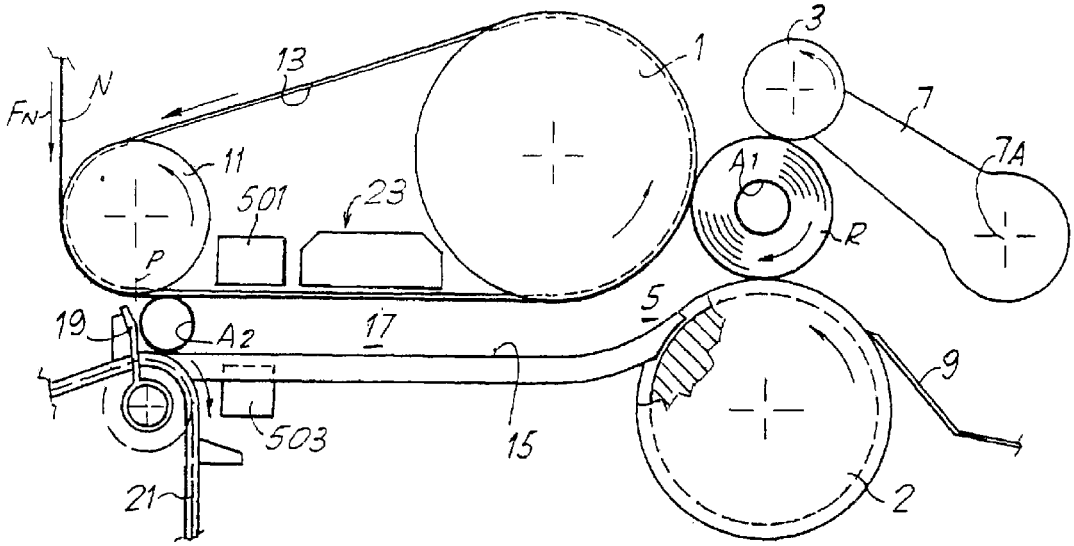

Operation of the machine described so far is as follows. FIG. 1A shows the initial moment of insertion of the new core A2 in the channel 17; on this core, winding of a new log will begin, after completion of the log R wound around the core A1. FIG. 1B shows the moment after, when the core A2 is in contact with the rolling surface 15 and with the web material N which is pinched between the core and the member 13. The core is rolling on the surface 15 and is angularly accelerated until its point of contact with the web material N is brought to the same feed speed as the material itself.

Figure 1C:
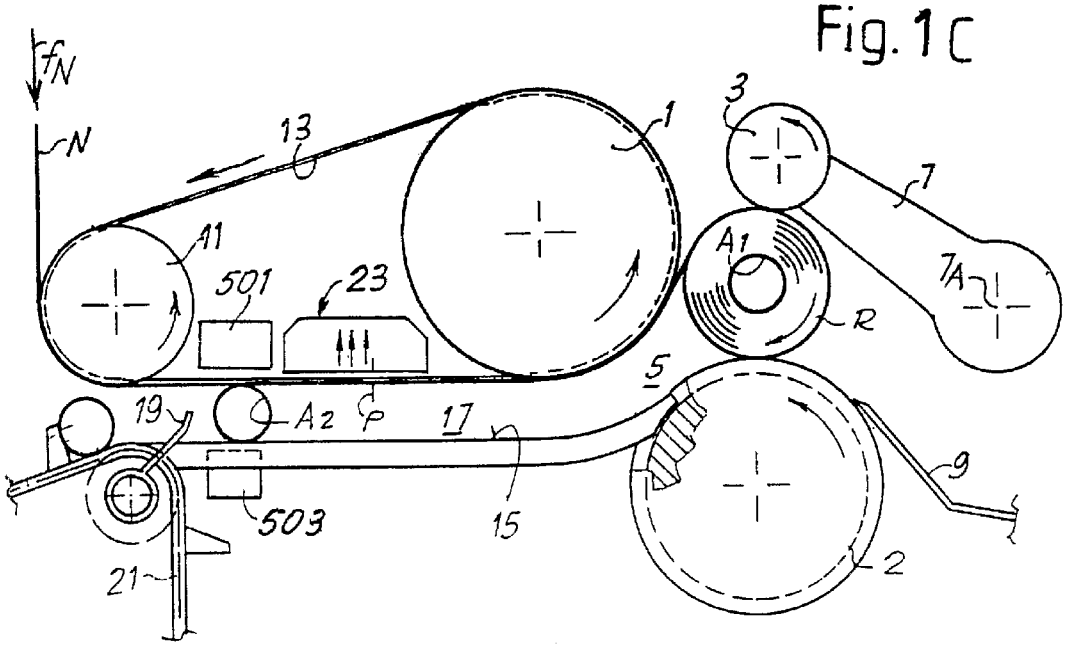

FIG. 1C shows the moment immediately prior to breakage or interruption of the web material. The log R wound around the winding core A1 is ready to be expelled from the winding cradle, while the new core A2 is passing between the two bars 501, 503 and is electrostatically charged by means of the bar 503, while the bar 501 charges with the opposite sign a portion of the web material, adjacent to the area in which it will be interrupted and in which the initial free edge will be formed for adhesion to the new core A2.

Figure 1D:
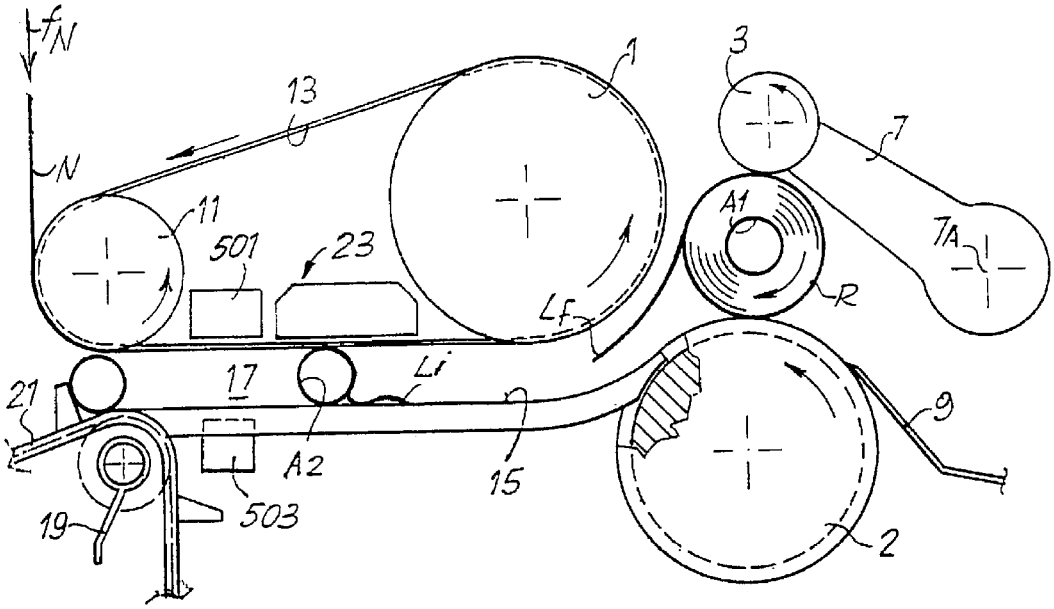

As can be seen in FIG. 1C and the subsequent FIG. 1D, the rolling surface 15 has a comb-type structure or at least a series of notches which allow the taker-in 19 to complete the rotation around its own rotation axis and prepare for insertion of the next core.

P indicates the position of a crosswise perforation line, generated on the web material N by the perforator (not shown), along which the web material is torn. The perforation P is located immediately downstream of a suction area defined by suction apertures, slots or holes along a lower surface of a suction box formed by the suction member 23. The suction is controlled and timed in order to operate when the perforation line P is in the position indicated in FIG. 1C, or slightly farther downstream in the feed direction of the web material N. In this way, when suction is activated, the web material is braked sharply, in the area where the suction holes or apertures are located with the log R and the suction area is tensioned and tears along the perforation line P, which constitutes the weakest section of the web material. The winding roller 1 has a surface with a high friction coefficient between the belts 13A that form the member 13, so that tearing of the web material occurs on the perforation line nearest the area in which the suction is applied. In practice, the high friction coefficient of the surface of the roller 1 with which the web material N is in contact prevents spreading of the tension downstream, towards the log R1 which is being completed.

As can be seen in FIG. 1C, the core A2 is already in contact with the web material N upstream of the tearing and suction area and has already been set to rotation and electrostatically charged by the bars 501, 503. When the tension induced as described above causes the web material to tear along the perforation line P, the core A2 holds the web material N against the belts forming the feed member 13 and thus prevents loss of the initial free edge Li of web material N that has formed due to the tear. Furthermore the core circumscribes and limits the stretch of web material that slackens due to the braking imposed by the suction. In fact the web material upstream of the contact area with the core A2 does not slacken, with consequent advantages in terms of absence of wrinkles in the turns inside the log. The final free edge Lf of the log R finishes winding on the log, which is expelled by varying the peripheral speed of the roller 2 and/or of the roller 3, in a per se known manner. To facilitate tearing or interruption of the web material by means of the suction applied on it, it is also possible to temporarily accelerate the winding roller 3 before activating the suction. This acceleration, even slight, pre-tensions the web material and guarantees tearing as soon as the suction is activated.

The electrostatic charge applied on the core A2 immediately prior to or during tearing of the web material N (if necessary combined with the opposite charge applied to the web material N) causes the initial section of web material to be electrostatically attracted to the core and adhere to it, as if glue had been applied to the core (FIG. 1D). The proximity of the electrostatic charge of the core and tearing of the web material N, in both spatial and temporal terms, ensures that the electrostatic charges are not dispersed and the electrostatic attraction is very efficient.

Since the rollers 1 and 11 continue to rotate, after breakage of the web material the feed member 13 continues to roll and to advance the core A2 along the channel 17. The point of contact between core and feed member 13 exceeds the suction area (FIG. 1B) and the initial free edge Li of the web material N adheres to the core due to the electrostatic charges on it, thus starting winding of a new log. The finished log R is still in the winding cradle, but could also have initiated its discharge movement. In this phase the suction has already been interrupted. The final edge Lf of the web material finishes winding on the log R and will be glued to it in the known manner.

Once winding on the new log around the core A2 has been completed, the switchover cycle described above is repeated.

As mentioned previously, the core insertion channel 17, along which the electrostatic systems that apply the charges on the core and/or on the web material are arranged, can be designed differently. The belts 13 can be absent, while the surface 15 develops roughly coaxially with the surface of the winding roller 1 for a portion of it. In this configuration, one single lower electrostatic bar can be provided, for example. The web material interruption system can be of the known type, positioned below the surface 15, or can be based on methods that use acceleration of the winding roller 3 and/or jets of air, suction or combinations thereof. Tearing systems that can be used are also those described in WO-A-2004/005173.

Figure 2:
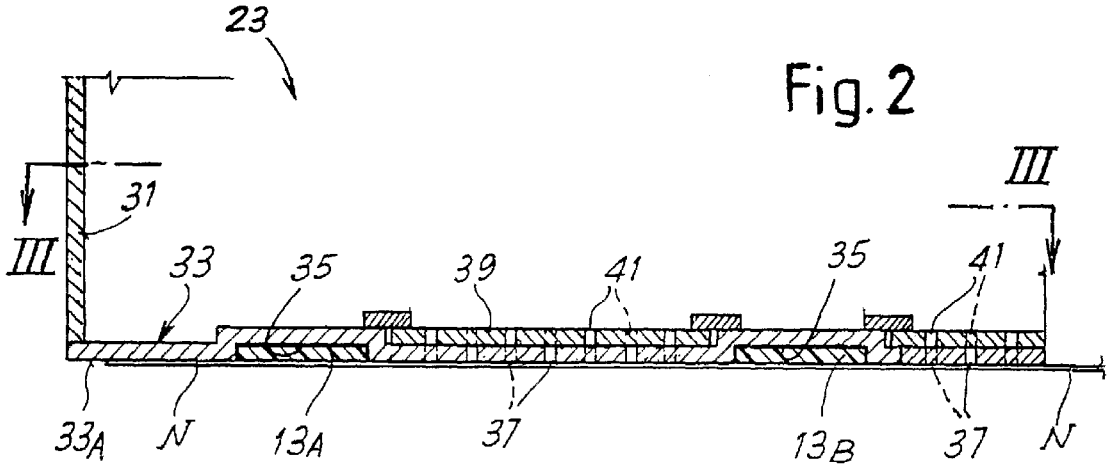
FIG. 2 shows a partially enlarged section view, according to a plane crosswise to the feed direction of the web material, of the suction member and the winding core feed member.
Figure 3:
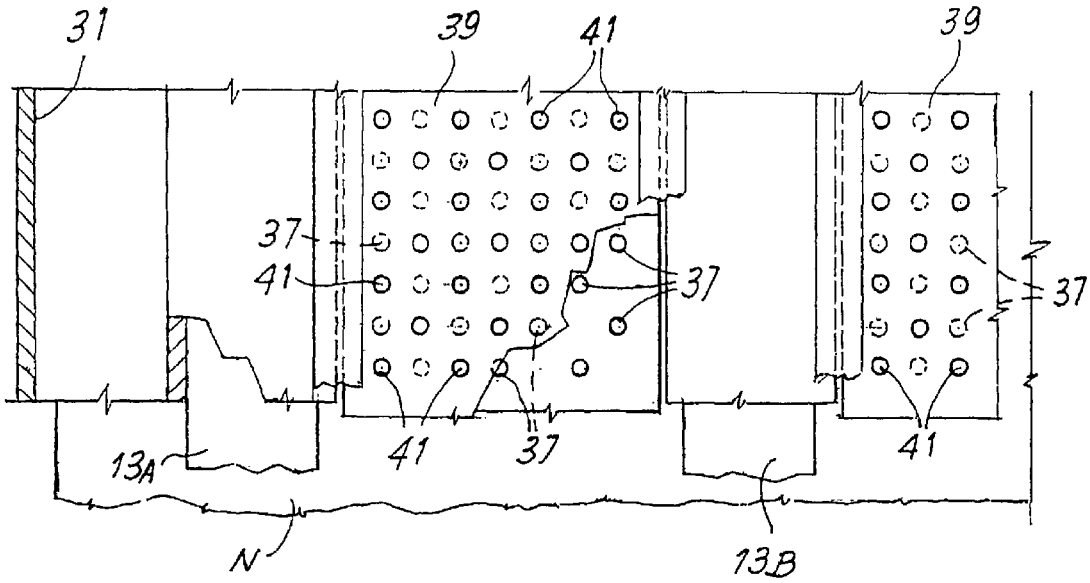
FIG. 3 shows a partial section according to III-III of FIG. 2.

FIGS. 2 and 3 show a cross section and a section according to III-III of FIG. 2, respectively, of the suction member 23. It has a suction box 31 the bottom of which is defined by a wall 33 along the outer surface 33A of which the web material runs. The outer surface of the wall 33 forms a counter surface on which the web material runs and against which it is pressed by the winding core which is inserted in the channel 17 at each switchover cycle. The wall 33 forms housings 35 parallel to the feed direction of the web material N, within which the parallel belts 13A forming the feed member 13 run. The outer surfaces of the belts 13A are flush with the outer surface 33A of the wall 33 or slightly protruding from it.

Between adjacent belts 13A the wall 33 is provided with respective perforated portions, i.e. through holes, openings or apertures 37. At the level of these perforated portions inside the suction box 31 diaphragms or laminas 39 are provided sliding parallel to the feed direction of the web material N, also provided with holes 41 staggered with respect to the holes 37, as can be seen in particular in FIG. 3. The diaphragms or laminas 39 form closing and opening elements which, sliding alternatively in one direction and the other, open and close the holes 37 alternatively communicating with the inside of the suction box 31 or intercepting said communication. In this way, with the diaphragms 39 moving alternatively in one direction and the other, the suction is activated and deactivated in a timed manner according to the position of the perforation line P for tearing of the web material. The inside of the suction box 31 can remain constantly at an underpressure, i.e. at a pressure below the atmospheric pressure, thus guaranteeing rapid cut-in of the suction even when the winding cycle is very short. The underpressure in the suction box 31 is maintained for example by means of connection to a vacuum pump, a fan or other suitable suction means not shown.

Figure 4:
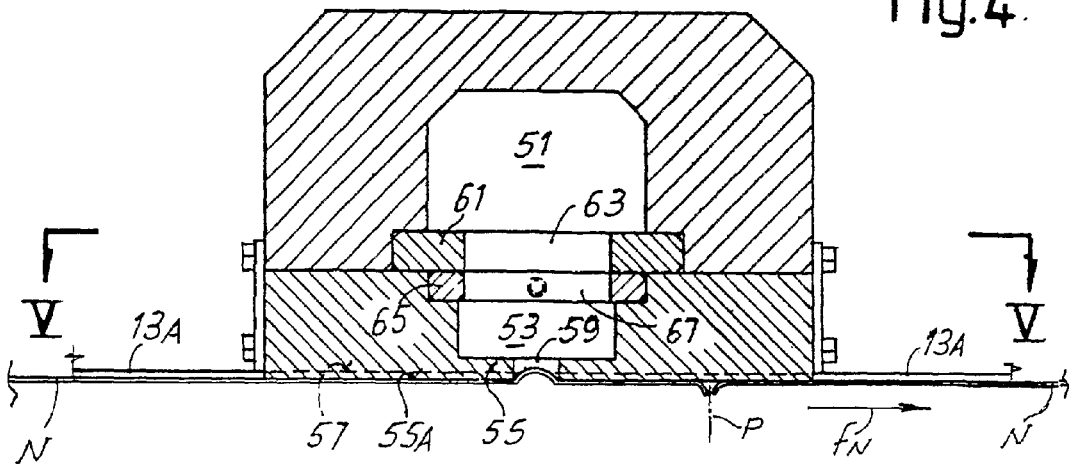
FIG. 4 shows a section of the suction member in a different embodiment.
Figure 5:
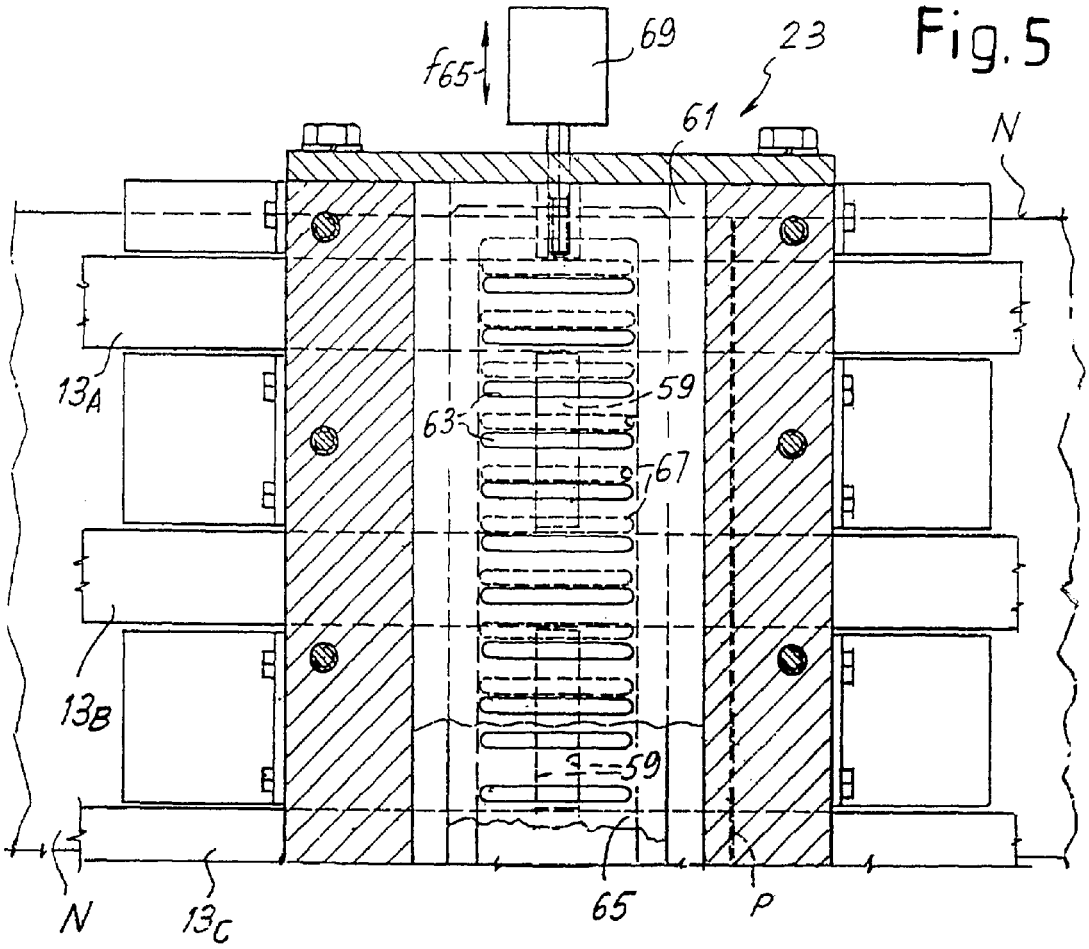
FIG. 5 shows a section according to V-V of FIG. 4.

FIGS. 4 and 5 show a different configuration of the suction member. In this case the suction member 23 comprises a continuous suction chamber 51, i.e. a chamber in which a pressure below the atmospheric pressure is constantly maintained. This chamber can be connected, at certain set times, to a timed suction chamber 53, the lower wall of which 55 defines a counter surface 55A having functions analogous to those of the counter wall 33A described above. In the wall 55 housings 57 are provided in which the belts 13A forming the feed member 13 run.

The wall 55 has a crosswise slot or aperture 59, if necessary interrupted at the level of the belts 13A. Via this crosswise aperture or slot 59 the braking suction effect is applied on the web material N causing breakage thereof along the perforation line P. To obtain a suction effect correctly controlled over time, of appropriate duration and timed with the passage of the perforation line P, the chambers 53 and 55 are connected via a valve system comprising a fixed plate 61 to a series of apertures or slots 63 elongated according to the feed direction of the web material N and positioned side by side crosswise to the feed direction. Below the fixed plate 61 is a sliding plate 65 provided with slots or apertures 67 extending analogously to the apertures or slots 63. The sliding plate 65 is furthermore connected to an actuator 69 which controls timed sliding of the plate according to the double arrow f65 (FIG. 5).

As can be observed in FIG. 5, the two plates 61 and 65 can be positioned so that the slots 63 and 67 are staggered and therefore the two suction chambers 51 and 53 are isolated from one another. In this case no suction is applied on the web material N. This is the set-up during normal winding of the log R. When the web material has to be torn or interrupted, the movable plate 65 is translated in one direction or the other according to the arrow f65 to align the apertures or slots 67 with the slots 63 (as in FIG. 5), and therefore connect the suction chamber 53 to the suction chamber 51. In this condition the suction effect is exerted on the web material N, braking it and thus causing it to tear.

A further embodiment of a rewinding machine according to the invention is shown in FIG. 6A-6E, where equal numbers indicate parts equal or equivalent to those of the preceding embodiments. In the embodiment example of FIG. 6A-6E the configuration of the winding members is substantially the same as in FIG. 1A to 1D. However, here the suction member is replaced by a mechanical interruption member. Said mechanical member, indicated by 111, is positioned in the space enclosed within the flexible member 13 and the rollers 1 and 11 and rotates around an axis X parallel to the axis of the rollers. The direction of rotation is, in this example, opposite to the direction of rotation of the rollers 1 and 11, i.e. it rotates in a clockwise direction in the drawing.

The member 111 is provided with a series of pressers 113 fitted at the end of arms of length such that the cylindrical envelope surface of the pressers 113 protrudes slightly from the surface defined by the belts 13A forming the flexible member 13.

Figure 6A:
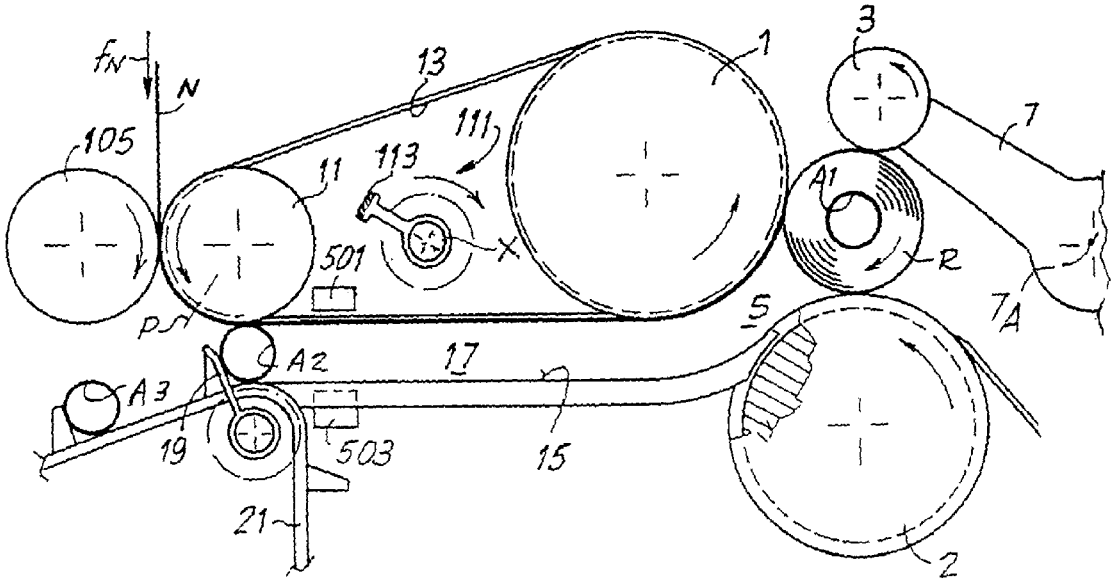
FIG. 6A-6E show an operating sequence of a further embodiment of the machine according to the invention.

In FIG. 6A the log R formed around the core A1 is in the winding cradle formed by the rollers 1, 2 and 3 and has been almost completed. The new core A2 is pushed by the taker-in 19 into the channel 17 formed between the belts 13A of the flexible member 13 and the rolling surface 15. P indicates the instantaneous position of the perforation line along which the web material will break. Said position is upstream of the position of the new core A2. The interruption member 111 is rotating around its own rotation axis X and the pressers 113 are facing upwards, i.e. on the opposite side with respect to the channel 17.

Figure 6B:
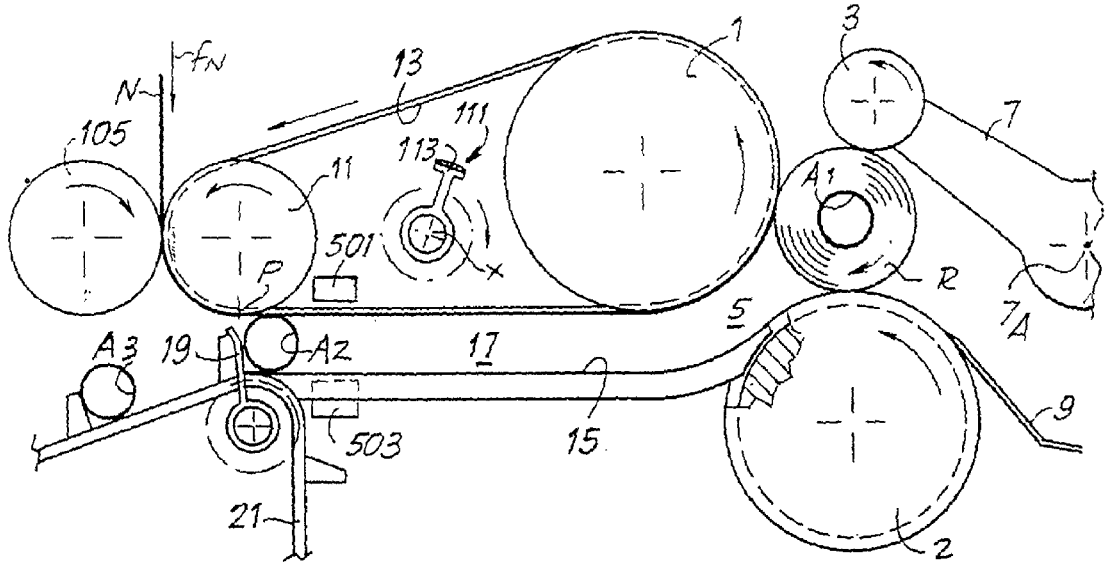

In FIG. 6B the core A2 is beginning to roll in the channel 17 and moves towards the operating area of the bars 501, 503 of the electrostatic device. The rotating interruption member 111 continues to rotate. The perforation line P along which the web material will be interrupted is still upstream of the core A2.

Figure 6C:
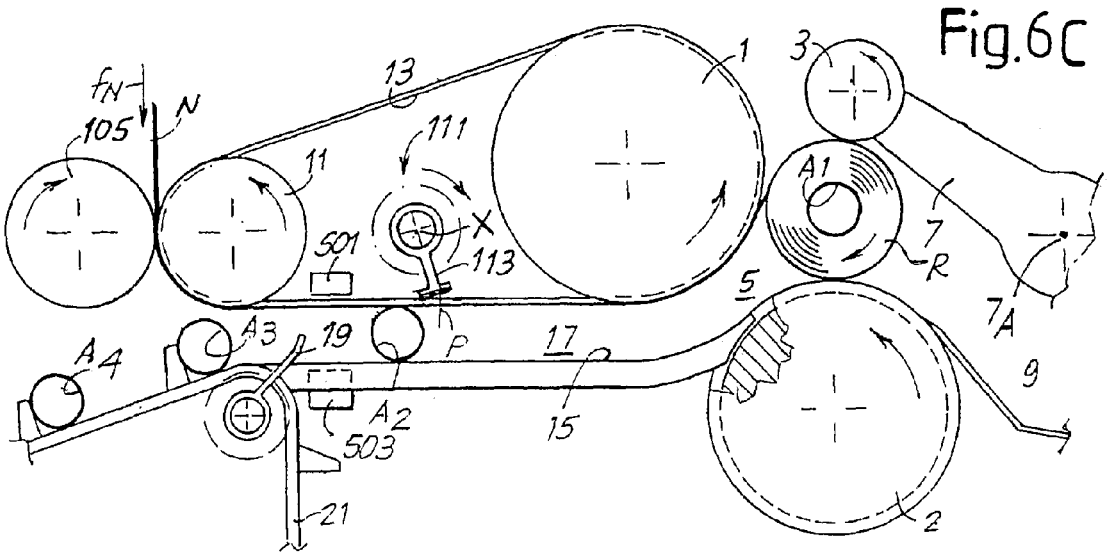

In FIG. 6C the core has advanced farther, rolling on the surface 15, and the perforation line P is downstream of the core A2, which has been electrostatically charged passing between the bars 501, 503. The pressers 113 of the rotating interruption member 111 are now facing downwards, about to penetrate between the belts 13A.

Figure 6D:
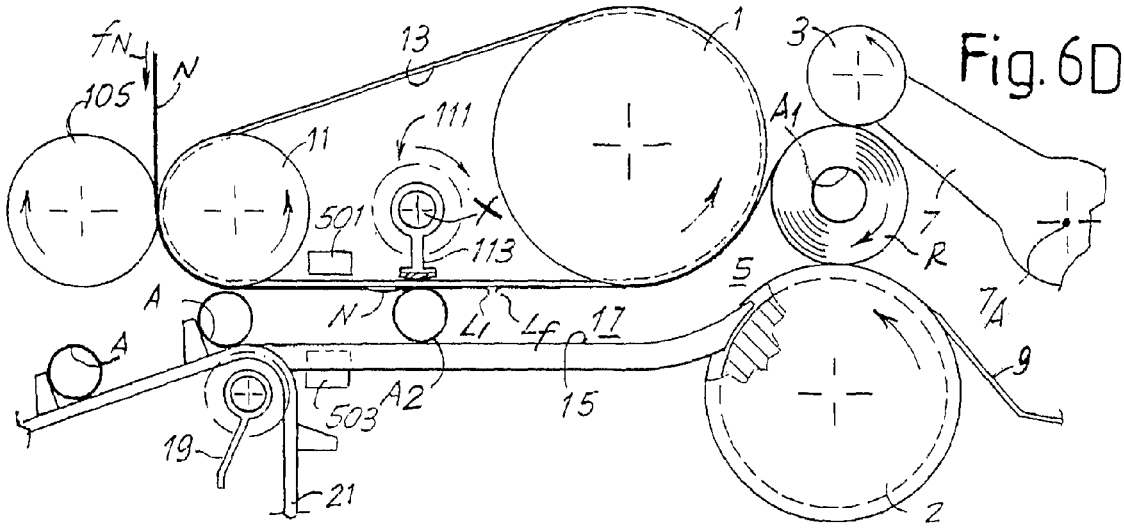
Figure 6E:
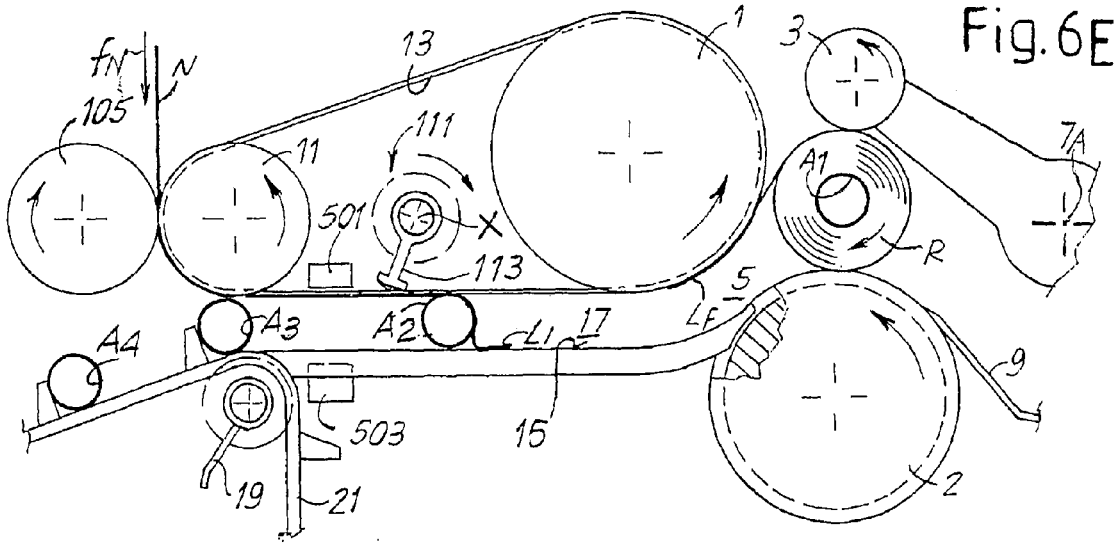

In FIG. 6D the pressers 113 are in a position orthogonal to the surface defined by the lower branch of the flexible member 13, at the moment when the core A2 passes below them. In this way, due to the fact that the pressers 113 (coated in elastic material with high friction coefficient) protrude slightly beyond the flexible member 13, the web material N is pinched between said pressers and the core A2. The speed of the member 111 is different from the speed of the web material (opposite, in the example) and this causes tearing along the perforation line P due to overtensioning of the web material. FIG. 6E shows the moment after, when the member 111 is no longer in contact with the web material N, the final free edge Lf of which finishes winding on the log R while the initial free edge Li is electrostatically attracted to the winding core A2 and begins to wind on it.

The member 111 could also rotate in the opposite direction with respect to the direction indicated in FIG. 6A-6E, provided that the pressers 113 have a different speed with respect to the speed of the web material N, to exert a braking effect on it and therefore to tension it and break it.

In a different embodiment, not illustrated, the mechanical interruption member can act in advance with respect to passage of the core A2. In this case it will not have the effect of countering the core A2. Tearing of the web material can nevertheless be obtained, for example by giving the surface of the interruption member which comes into contact with the web material a particularly high friction coefficient, with a slightly abrasive or adherent coating, for example a coat of abrasive material. Alternatively the mechanical member can be provided with tips or pins that penetrate the web material, retaining it or pulling it in the opposite direction with respect to the feed direction of the web material N. In any case the mechanical member exerts a delaying, braking, retaining or obstructing action to the forward movement of the web material N, and this action is sufficient to cause tearing thereof. Vice versa provision can be made for the mechanical member, when it rotates as in the example in FIG. 6A-6E, to exert a local acceleration action on the web material. For example the mechanical member can rotate so that, when it acts on the web material N, it moves in the same direction as the latter but at a higher speed. By providing a surface with a sufficiently high friction coefficient and/or a series of tips or pins which penetrate the web material, the web material can be tensioned between the pinching point by the new core A2 and the point of contact with the mechanical interruption member. The interruption is performed by tearing of the perforation line which is located, by appropriate timing of the machine, in the portion of the web material subject to traction.

The winding core can be a core designed to remain in the end product, or can be extracted after winding of the log and recycled if necessary. The web material interruption system acts in both cases in an equivalent way. The absence of glue facilitates the use of recyclable cores, which do not need to be cleaned to eliminate remains of glue and/or web material adhering to them.

Figure 7:
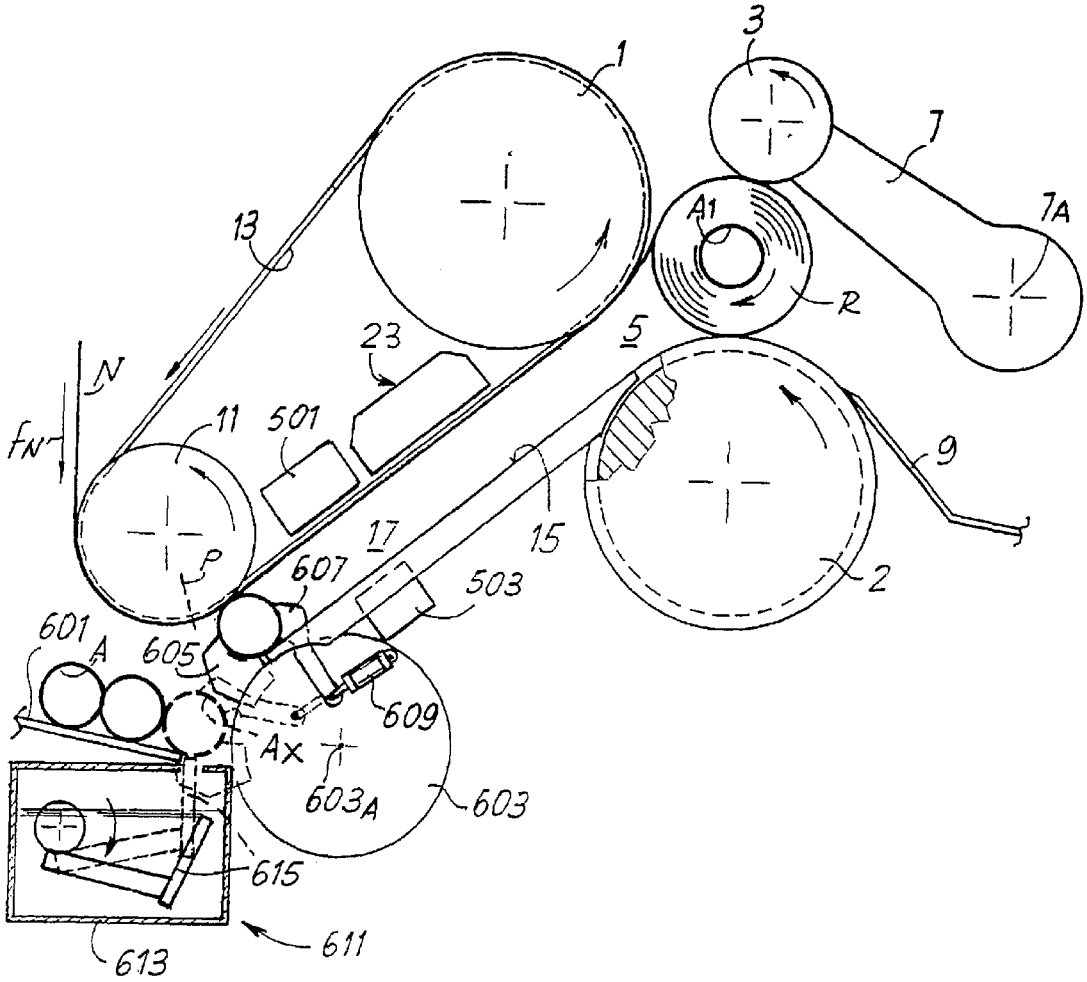
FIG. 7 shows a modified embodiment of the invention.

FIG. 7 shows a modified embodiment, in which the electrostatic charges are used in combination with glue. Equal numbers indicate parts equal or corresponding to those of the embodiment examples illustrated in the preceding figures. In the example of FIG. 7, upstream of the inlet of the channel 17, the end of a chute 601 is positioned for the winding cores A. The first core of the row is engaged by a taker-in consisting of a member 603 rotating around an axis 603A, which is fitted with a fixed jaw 605 and a movable jaw 607 controlled by an actuator 609 supported by the rotating member 603 and the operation of which will be described below.

Below the chute 601 a glue applicator 611 is positioned comprising a glue container 613 inside which a device 615 is immersed, provided, in the example illustrated, with a reciprocating movement, dipping into and emerging from the glue to apply a strip of glue on the core which is in position Ax.

Operation of the machine in the configuration of FIG. 7 is as follows. When a log R is about to be completed, a (continuous or discontinuous) strip of glue is applied on the core in position Ax by means of the device 615 which takes the glue from the container 613. The core is engaged by the fixed jaw 605 and by the movable jaw 607 supported by the rotating member 603. At the moment when the new core has to be inserted in the channel 17 the rotating member 603 rotates in a clockwise direction to bring the jaws from the position in which they grip the core in position Ax to the position for insertion of the core in the channel 17, pushing the core between the rolling surface 15 and the web material N running on the flexible member 13. The core thus inserted starts to rotate, rolling on the surface 15 and the advancement thereof is permitted by opening of the movable jaw 607 controlled by the actuator 609.

Due to use of the jaws 605, 607, the angle at which the core A is inserted in the channel 17 and therefore also the position of the strip of glue applied on the core are controlled in a reliable manner and are therefore defined. The position of the strip of glue is timed with respect to the perforation line P along which the web material N has to be interrupted, so that when the core begins to roll on the surface 15, the strip of glue touches the web material immediately downstream of the perforation line P, i.e. in the area of material which, after interruption, will form the final free edge Lf of the completed log R. In this way, a strip of glue is applied on the final free edge Lf to close the final free edge without the need for a gluing machine downstream of the rewinding machine. To permit return of the core gripper jaws to the initial position, the next core can be temporarily withheld by a retaining system, for example a movable stop.

Adhesion on the core A of the initial free edge Li obtained by interruption of the web material N is obtained, vice versa, mainly due to the electrostatic attraction between the initial free edge Li and the core, according to the procedures already defined with reference to the previous implementation examples.

Interruption of the web material can be performed as described with reference to FIG. 1A-1D by suction (as indicated in FIG. 7). Alternatively, the suction system 23 can be replaced by a different interruption system, like the one illustrated in FIG. 6A-6E or any other suitable system.

Application of the glue on the web material at the level of the final free edge Lf can also be performed differently, for example by direct application, via a spray system or similar.

The drawing only shows practical embodiments of the invention, which can vary in the forms and arrangements without departing from the scope of the concept underlying the invention. Any presence of reference numbers in the appended claims has the sole aim of facilitating reading thereof in the light of the description and appended drawings, but does not limit the scope of its protection in any way.

The invention claimed is:

1. A rewinding machine comprising:

a path for feeding a web material towards a winding system;

an interruption member to interrupt the web material at an end of winding of a log;

a core insertion channel, said channel being defined by a stationary rolling surface and a movable member including a series of parallel spaced apart flexible members entrained around at least two rollers;

a core feeder to insert winding cores in succession in said channel; and an electrostatic device to electrostatically charge at least one of the web material and the winding cores to provide, due to electrostatic charges, reciprocal adhesion of each core and an initial free edge of the web material obtained by interruption of the web material at an end of winding of each log, wherein said electrostatic device includes at least one charge bar connected to a voltage source, said at least one charge bar being positioned along said channel, and said at least one charge bar is constructed and arranged within a closed path defined by said flexible members such that electrostatic charges are applied by said at least one charge bar to at least one of said web material and each said core after the core has come into contact with the web material to provide said reciprocal adhesion between said each core and said initial free edge of the web material.

2. The rewinding machine as claimed in claim 1, wherein said movable member and said rolling surface are positioned so that when said core is inserted in said channel, the web material is between said core and said movable member and in contact with said movable member.

3. The rewinding machine as claimed in claim 2, wherein said movable member is a core feed member.

4. The rewinding machine as claimed in claim 1, wherein said movable member is a core feed member.

5. The rewinding machine as claimed in claim 1, wherein one of said at least two rollers around which said flexible members are entrained is a winding roller forming part of the winding system and around which the web material is entrained, said winding system being a peripheral winding system.

6. The rewinding machine as claimed in claim 1, wherein the interruption member is combined with said flexible members and positioned with respect to said flexible members on an opposite side of the channel to act on the web material through said flexible members.

7. The rewinding machine as claimed in claim 1, wherein said at least one charge bar is positioned to electrostatically charge said cores, one charge bar is positioned to electrostatically charge said web material.

8. The rewinding machine as claimed in claim 1, wherein at least one of said at least one charge bar of the electrostatic device is housed between said at least two rollers around which said flexible members are entrained within said closed path defined by said flexible members.

9. The rewinding machine as claimed in claim 1, wherein said interruption member is arranged between said at least two rollers around which said flexible members are entrained, and said interruption member acts on said web material through said flexible members.

10. The rewinding machine as claimed in claim 9, wherein said at least one charge bar is arranged on a side of said channel opposite said interruption member.

11. The rewinding machine as claimed in claim 1, wherein said stationary rolling surface includes a comb-structure, said at least one charge bar of said electrostatic device being arranged so as to act through said comb-structure.

12. The rewinding machine as claimed in claim 1, further comprising a gluing device for applying glue to a final free edge of a log.

13. The rewinding machine as claimed in claim 12, wherein said gluing device comprises a glue dispenser to apply glue on said core which transfers said glue to the web material.

14. A method for producing logs of wound web material comprising:

feeding a web material to a winding system;

winding a first log of web material around a first winding core;

interrupting the web material at an end of winding of said first log forming a final free edge of said first log and an initial free edge for winding of a second log; and adhering said initial free edge to a second core by application of electrostatic charges which produce reciprocal attraction between said second core and said initial free edge, wherein said application of said electrostatic charges is after the second core has come into contact with the web material; and said electrostatic charges are provided to at least one of said web material and each core along a core insertion channel defined by a stationary rolling surface and within a closed path defined by a movable member so as to provide said reciprocal attraction between said second core and said initial free edge.

15. The method as claimed in claim 14, wherein said application of the electrostatic charges is to said first core or said second core, or said first core and said second core.

16. The method as claimed in claim 14, wherein said application of said electrostatic charges is to said web material.

17. The method as claimed in claim 14, wherein said interrupting of the web material is after the second core has been brought into contact with the web material.

18. The method as claimed in claim 14, wherein said application of the electrostatic charges is to cores when the cores pass along an insertion channel into which said cores are inserted and which said cores move along for positioning for said winding to form logs of web material.

19. The method as claimed in claim 14, wherein said winding system is a peripheral winding system comprising a winding cradle.

20. A method for producing logs of wound web material comprising:

feeding a web material to a winding system;

winding a first log of web material around a first winding core;

interrupting the web material at an end of winding of said first log forming a final free edge of said first log and an initial free edge for winding of a second log; and adhering the initial free edge to a second core by application of electrostatic charges which produce reciprocal attraction between said second core and said initial free edge, wherein cores are inserted in an insertion channel defined by a stationary rolling surface and a movable member including a series of parallel spaced apart flexible members entrained around at least two rollers, and wherein said application of the electrostatic charges occurs along said channel and within a closed path defined by said flexible members at a point so as to provide said reciprocal attraction between one said core and said initial free edge.

21. The method as claimed in claim 20, wherein application of said electrostatic charges is to said first core or said second core, or said first core and said second core.

22. The method as claimed in claim 20, wherein said application of said electrostatic charges is to said web material.

23. The method as claimed in claim 20, wherein said interrupting of the web material is after the second core has been brought into contact with the web material.

24. The method as claimed in claim 20, wherein said winding system is a peripheral winding system comprising a winding cradle.

25. The method as claimed in claim 24, wherein said flexible members are entrained around a winding roller forming part of said winding cradle.

26. The method as claimed in claim 20, further comprising arranging a web interruption member between said at least two rollers, said web interruption member acting on said web material through said flexible members entrained around said at least two rollers.

27. The method according to claim 26, further comprising arranging an electrostatic charge bar along said channel opposite said interruption member.

28. The method according to claim 26, further comprising arranging an electrostatic charge bar along said channel and between said at least two rollers within said closed path defined by said flexible members.

29. The method as claimed in any one of claims 15 to 22, wherein said interrupting of the web material is after the second core has been brought into contact with the web material.

30. The method as claimed in claim 14 or 20, wherein said interrupting of the web material is immediately after said application.of the electrostatic charges.

31. The method as claimed in claim 17 or 20, wherein glue is applied to the final free edge of said log.

32. The method as claimed in claim 14 or 20, wherein glue is applied to said second core and transferred via said core to the web material.

* * * * *

UNITED STATES PATENT AND TRADEMARK OFFICE

CERTIFICATE OF CORRECTION

PATENT NO. : 7,896,284 B2
APPLICATION NO. : 10/588797
DATED : March 1, 2011
INVENTOR(S) : Morelli et al.

It is certified that error appears in the above-identified patent and that said Letters Patent is hereby corrected as shown below:

Title Page:
Item (75) in line 1, "S. Maria a Colle (IT)" should read -- Lucca (IT) --.

Column 1:
Line 60, "web, material" should read -- web material --.

Column 2:
Line 43, "formed via cuffing" should read -- formed via cutting --.

Column 6:
Line 45, "core talker-in is" should read -- core taker-in is --.

Column 7:
Line 64, after "aperatures are located" and before "with the log R" insert omitted text as follows:
-- . As the log R continues to rotate, the web material between the tangent point --.

Column 13:
Claim 7, lines 13-14, after "charge said cores" delete ", one charge bar is positioned to electrostatically charge said web material".

Column 14:
Claim 31, line 60, "claim 17 or 20" should read -- claim 14 or 20 --.

Signed and Sealed this
Third Day of April, 2012

David J. Kappos

David J. Kappos
*Director of the United States Patent and Trademark Office*